US006746256B1

(12) United States Patent
Wang

(10) Patent No.: US 6,746,256 B1
(45) Date of Patent: Jun. 8, 2004

(54) ELECTRONIC CARD CONNECTOR WITH PUSHING ASSEMBLY FOR TWO-STAGE OPERATION

(76) Inventor: Ming-Te Wang, No. 3, Lane 560 Chung Cheng Rd., Hsin Tien City, Taipei (TW)

( * ) Notice: Subject to any disclaimer, the term of this patent is extended or adjusted under 35 U.S.C. 154(b) by 0 days.

(21) Appl. No.: 10/700,594

(22) Filed: Nov. 5, 2003

(51) Int. Cl.[7] ..... H01R 13/62
(52) U.S. Cl. ..... 439/159
(58) Field of Search ..... 439/159, 160, 439/607, 609

(56) References Cited

U.S. PATENT DOCUMENTS 6,482,020 B1 * 11/2002 Yeh ..... 439/159
6,554,627 B1 * 4/2003 Chen ..... 439/159
6,592,385 B1 * 7/2003 Chen ..... 439/159
6,619,971 B1 * 9/2003 Chen ..... 439/159
6,655,973 B2 * 12/2003 Ji et al. ..... 439/159

* cited by examiner

*Primary Examiner*—Gary Paumen

(57) ABSTRACT

An electronic card connector including an insulating body, a shielding member and a pushing assembly is disclosed. The insulating body includes a one-way track with a forwarding portion, a positioning portion, and a returning portion. The shielding member includes a spring leaf with a recessed rail corresponding to the forwarding portion. The free end of the spring leaf is bent to the forwarding portion and forms a tilt toward the positioning portion. The pushing assembly includes a guide lever with a first protrusion and a second protrusion for slidably moving in the one-way track and the recessed rail, respectively. As such, when the electronic card is inserted, the second protrusion is guided by the tilt to rest in the positioning portion; and when the electronic card is ejected, the first protrusion is guided in the returning portion back to the forwarding portion.

7 Claims, 9 Drawing Sheets

ELECTRONIC CARD CONNECTOR WITH PUSHING ASSEMBLY FOR TWO-STAGE OPERATION

BACKGROUND OF THE INVENTION

The present invention relates to an electronic card connector with pushing assembly for two-stage operation, and more particularly, to a connector providing an electronic card to be inserted by pushing the electronic card at the first stage and ejected at the second stage.

In recently years, various types of electronic cards have been applied to electronic products such as cellular phones, digital cameras, personal digital assistants. For example, the compact flash (CF) card, multimedia card (MMC) and secure digital (SD) card have been very commonly seen. Consequently, connectors which provide connection and positioning between the electronic cards and the electronic products have been developed, such that electric connection and data communication between the electronic cards and the electronic products can be established. However, as frequent insertion and ejection operations of the electronic cards are inevitable, endurance is highly demanded by the connectors to sustain iterative operations.

FIG. 1 shows a conventional electronic card connector. The connector allows an electronic card 4 to be pushed and plugged therein. The connector includes an insulating body 1, a shielding shell 2 and a pushing assembly 3. The shielding shell 2 is placed on top of the insulating body 1 to provide shielding effect. The insulating body 1 includes a base 10 with a first arm 11 and a second arm 12 stretching perpendicularly from two opposing ends of the base 10. The base 10, the first arm 11 and the second arm 12 construct a space 13 for receiving the electronic card 4. As shown in FIG. 1*a,* a one-way track 14 may be formed on the base 10 at the end where the second arm 12 stretches from. The one-way track 14 includes a forwarding portion 141, a positioning portion 142, and a returning portion 143 to form a loop, allowing a downward bending head 321 of a guide lever 32 to perform one-way movement therein. Adjacent to and circumscribed by the one-way track 14 is a positioning block 144. The positioning block 144 has a first side surface, a second side surface and a third side surface contoured with the forwarding portion 141, the positioning portion 142, and the returning portion 143, respectively. That is, the first side surface of the positioning block 144 extends along the forwarding portion 141 and terminates with a second side surface contoured with a recess, such that the downward bending head 321 approaching the end of the forwarding portion 141 will rest on the recess 145. The third side surface of the positioning block 144 has a first part parallel to the first side surface, and a second part bent to merge with the first side surface. The pushing assembly 3 includes a spring 30, a slide member 31 and the guide lever 32. One end of the spring 30 is mounted to the second arm 12, while the other end of the spring 30 is connected to the slide member 31. Therefore, the slide member 31 can move along the elongate direction of the second arm 12. The movement of the slide member 31 is actuated by insertion or ejection of the electronic card 4 in and out of the space 13. Further, the end of guide lever 32 is connected to the slide member 31 to be driven thereby. Therefore, when the electronic card 4 is pushed and inserted into the space 13, the lever head 321 is pushed to move towards the end of the forwarding portion 141. After reaching the end of the forwarding portion 141, by the force exerting from the spring 30, the lever head 321 is withdrawn to move into the positioning portion 142. The recessed structure of the positioning portion 142 then hooks the lever heat 321 on the recess 145. In this way, the electronic card 4 is properly positioned in the connector. By pushing the electronic card 4 towards the connector again, the lever head 321 is pushed away from the recess 145 towards the returning portion 143. By the restoring force exerting from the spring 122*a,* the lever head 321 moves along the returning portion 143 to generate an ejecting force against the electronic card 4. The electronic card 4 can thus be ejected from the connector.

The iterative insertion and ejection operations of the electronic card 4 generate friction between the lever head 321 and the one-way track 14 of the insulating body 1. As the guide lever 32 is typically fabricated from metal material, the abrasion thereon is even more serious. Particularly, the turning point 146 of the forwarding portion 141 and the positioning portion 142 is most easily abraded. Once the turning point 146 of the forwarding portion 141 and the positioning 142 is seriously abraded, a smooth or normal operation of insertion and ejection of the electronic card 4 will be seriously affected.

BRIEF SUMMARY OF THE INVENTION

The present invention provides an improved electronic card connector structure with pushing assembly for two-stage operation. Therefore, the abrasion and damage of the insulating body and the pushing assembly can be greatly suppressed to provide a smooth insertion and ejection operation and increase lifetime of the connector.

The connector provided by the present invention comprises an insulating body, a shielding member and a pushing assembly. The insulating body includes a base, and an elongate first arm and an elongate second arm extending perpendicularly from two ends of the base. A one-way track with a forwarding portion, a positioning portion, and a returning portion is consecutively formed on the first arm. The first arm and the second arm construct an open space for receiving the electronic card. The shielding member which covers the insulating body includes a spring leaf with a recessed rail corresponding to the forwarding portion. The free end of the spring leaf is bent to the forwarding portion and forms a tilt toward the positioning portion. The pushing assembly includes a resilient member, a slide member and a guide lever. One end of the resilient member is mounted to the first arm and the other end thereof connected to the slide member. The guide lever is pivotably connected to the slide member at one end thereof and has a first protrusion and a second protrusion at the other end thereof for slidably moving in the one-way track and the recessed rail, respectively. As such, when the electronic card is inserted, the second protrusion is guided by the tilt to rest in the positioning portion; and when the electronic card is ejected, the first protrusion is guided in the returning portion back to the forwarding portion.

BRIEF DESCRIPTION OF THE DRAWINGS

These, as well as other features of the present invention, will become apparent upon reference to the drawings wherein.

DETAILED DESCRIPTION OF THE INVENTION

Figure 1:
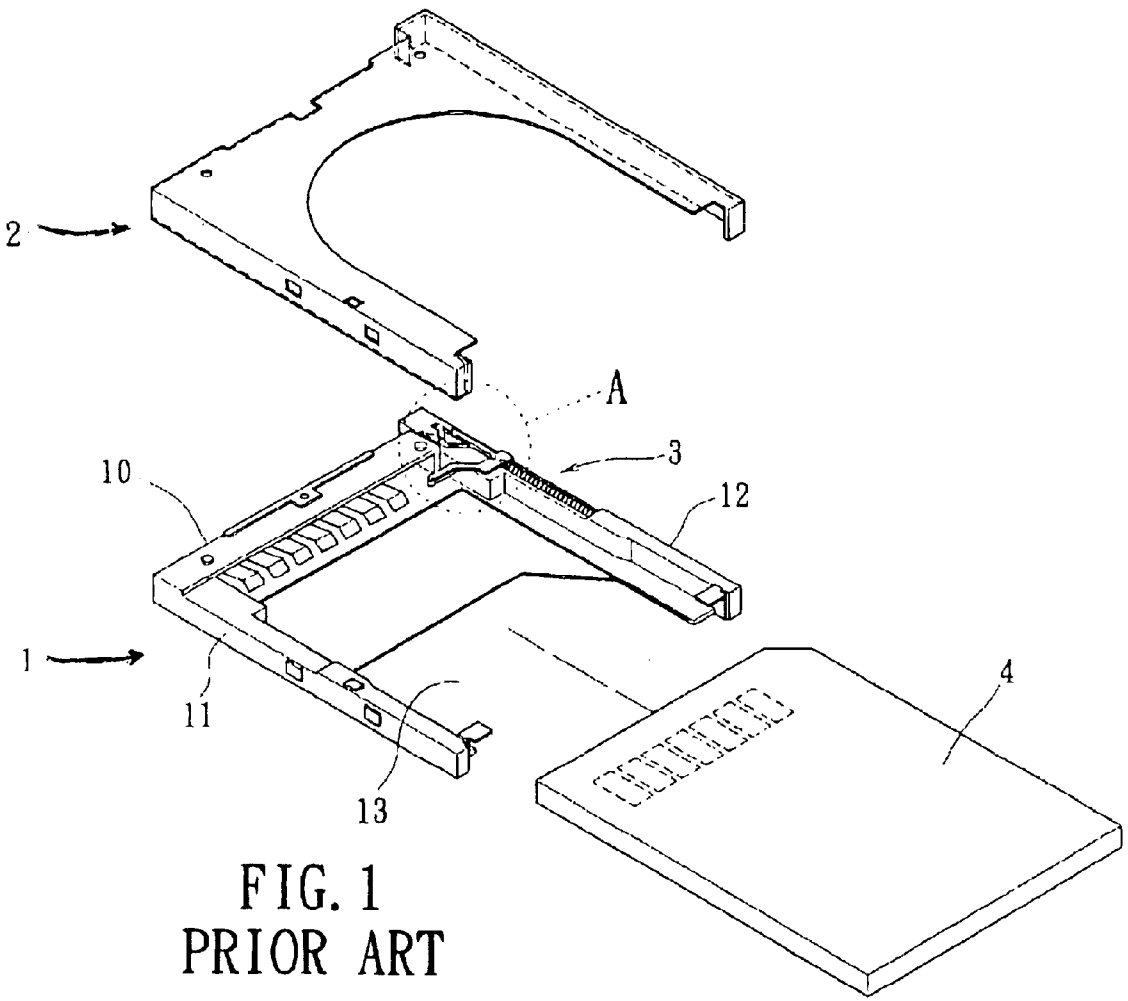
FIG. 1 PRIOR ART
FIG. 1 shows a conventional electronic card connector.
Figure 1A:
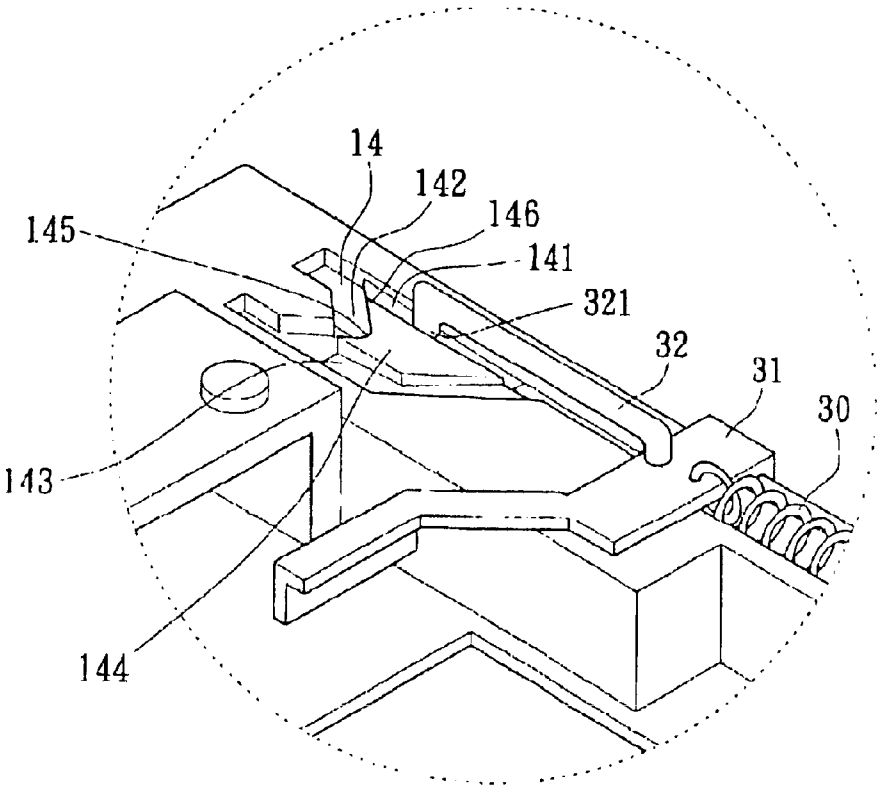
FIG. 1A PRIOR ART
FIG. 1*a* shows a local enlargement of FIG. 1.
Figure 2:
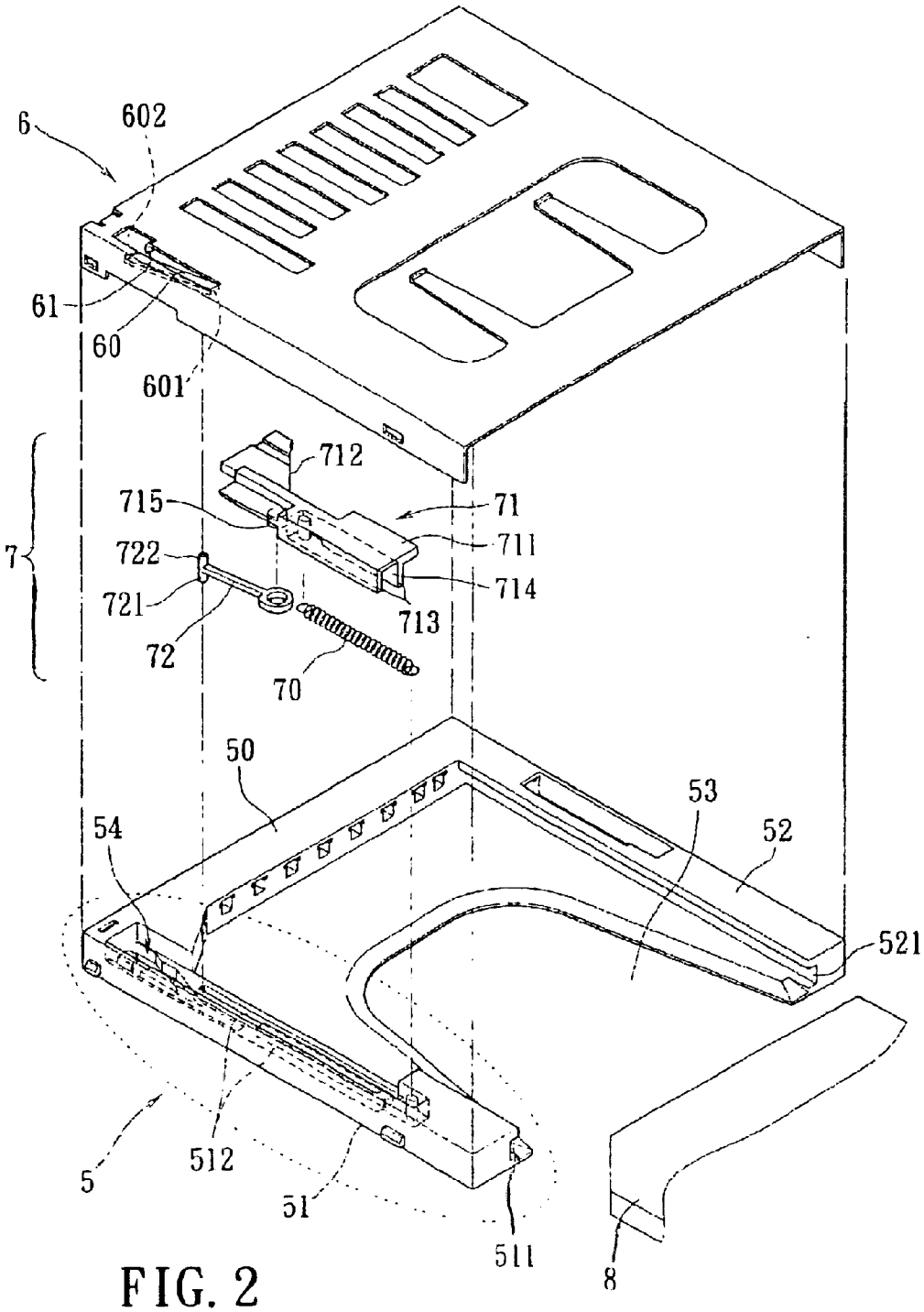
FIG. 2 shows an exploded view of an improved connector provided by the present invention.
Figure 2A:
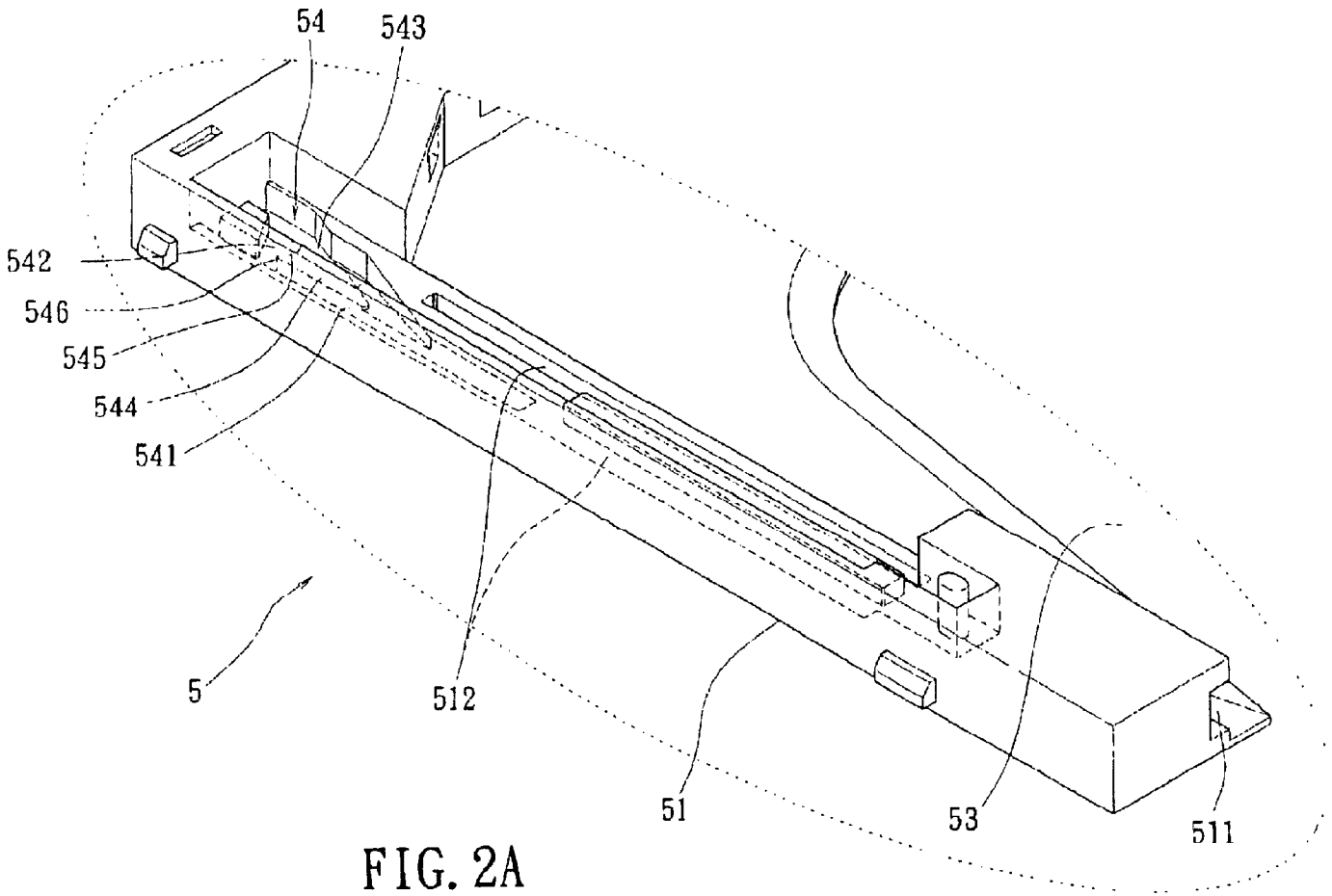
FIG. 2*a* shows an enlarged view of part A as shown in FIG. 2.
Figure 3:
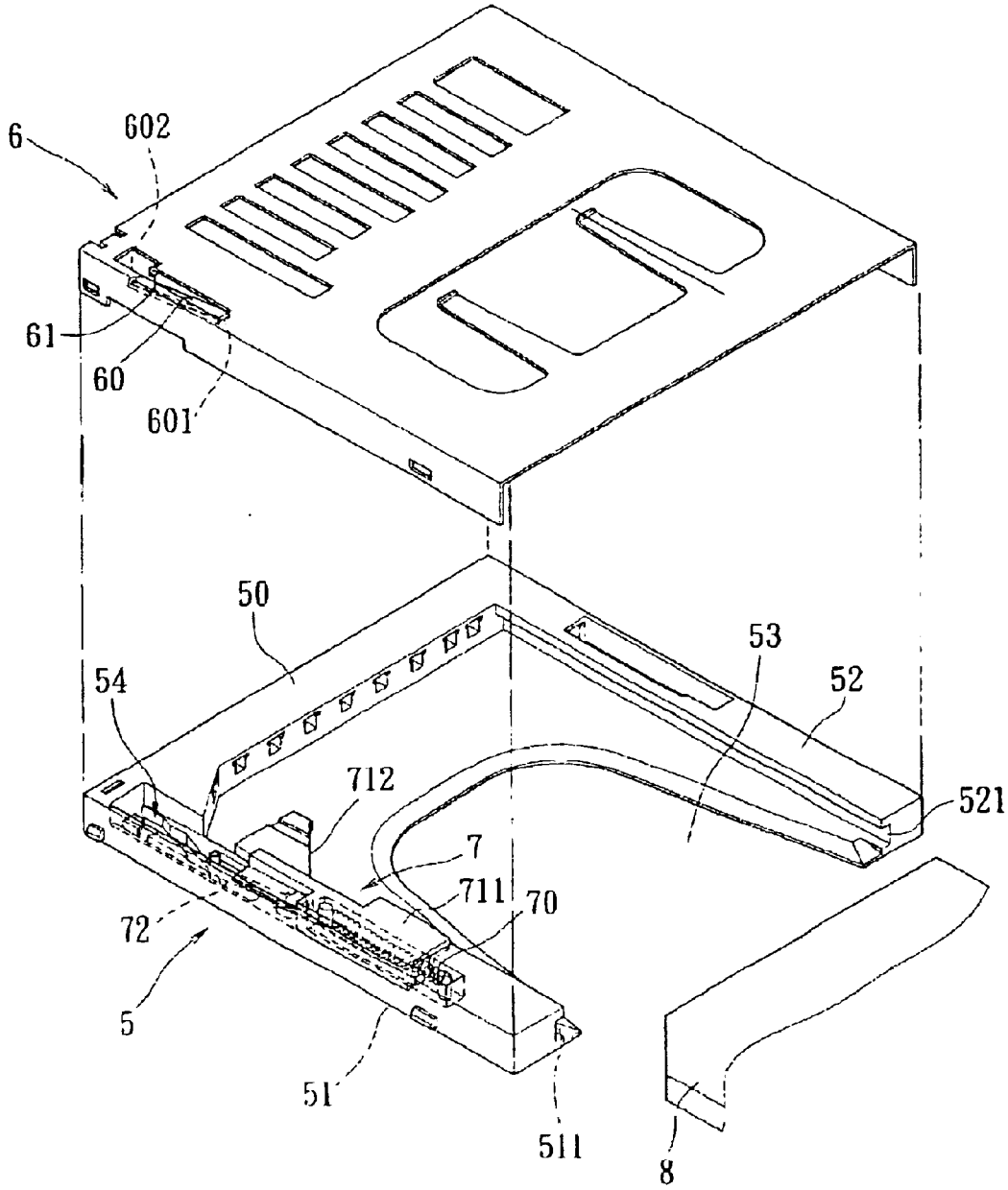
FIG. 3 shows a perspective view of a partial assembly of the connector shown in FIG. 2.

Referring to FIGS. 2, 2*a* and 3, a connector for inserting and ejecting an electronic card 8 of the present invention includes an insulating body 5, a shielding shell 6 and a pushing assembly 7.

The insulating body 5 includes a base 50, and an elongate first arm 51 and an elongate second arm 52 extending perpendicularly from two ends of the base 50. There are corresponding slots 511 and 521 formed in the first arm 51 and the second arm 52, respectively. The base 50, the first arm 51 and the second arm 52 construct an open space 53 for receiving the electronic card 8. A one-way track 54 is formed on the base 50 at the end where the first arm 51 stretches from. The one-way track 54 includes a forwarding portion 541, a positioning portion 542, and a returning portion 543 to form a loop. Adjacent to and circumscribed by the one-way track 54 is a positioning block 544. The positioning block 544 has a first side surface, a second side surface and a third side surface contoured with the forwarding portion 541, the positioning portion 542, and the returning portion 543, respectively. That is, the first side surface of the positioning block 544 extends along the forwarding portion 541, continues with a second side surface contoured with a recess 545, and terminates with a third side surface extending along the returning portion 543. However, the returning portion 543 of the one-way track 54 forms an upraising slope from the end connecting with the positioning portion 542. Therefore, the other end of the returning portion 543, which connects with the forwarding portion, is higher than the forwarding portion 541. Further, there is slide rail 512 formed in the first arm 51.

The shielding shell 6 is used to cover the insulating body 1 to prevent electromagnetic interference (EMI). The shielding shell 6 includes a spring leaf 60 with a recessed rail 60 corresponding to the forwarding portion 541 of the one-way track 54. The free end of the spring leaf 60 is bent to the forwarding portion 541 and forms a tilt 602 toward the positioning portion 542. The shielding shell 6 further includes a stop portion 61 corresponding to the recess 545 of the positioning block 544.

The pushing assembly 7 includes a resilient member 70, a slide member 71 and a guide lever 72. One end of the resilient member 70 is mounted to the first arm 51, while the other end of the resilient member 70 is fixedly connected to the slide member 71. The slide member 71 includes a slide portion 711 with a slide rack 713, and a contact portion 712. The slide rack 713 sits in the slide rail 512 of the first arm 51. Therefore, the slide member 71 is slidably mounted on the first arm 51 and a room 714 is formed to fulnish the resilient member 70 therein. The slide member 71 further includes a pivot 715 connecting to one end of the guide lever 72. Furthermore, the other end of the guide lever 72 is T-shaped with a downward protrusion 721 and an upward protrusion 722 pivotably mounted in the one-way track 54 and the recessed rail 601 of the spring leaf 60, respectively.

Figure 4:
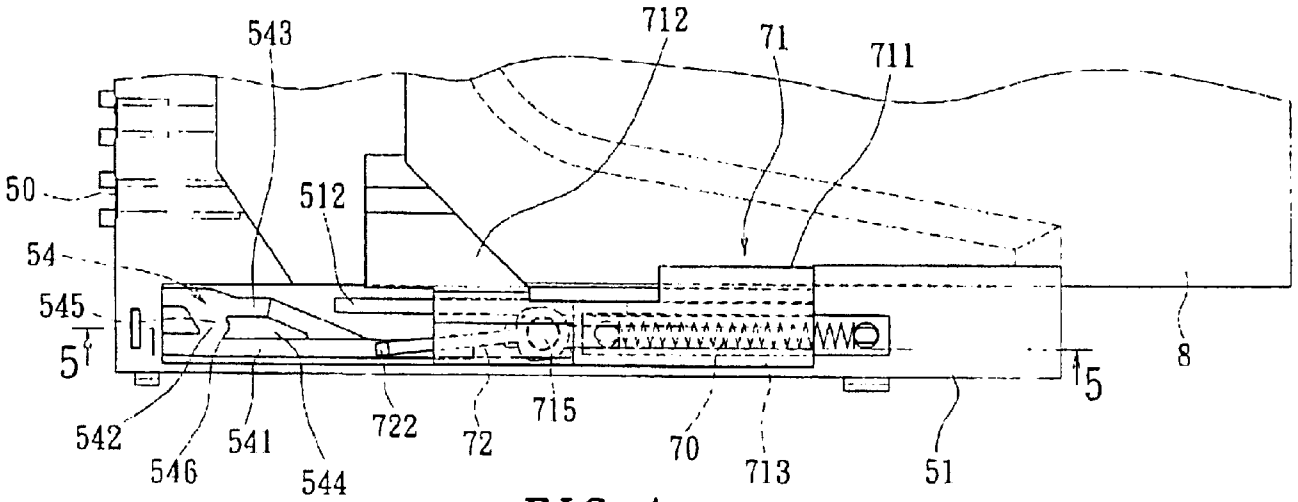
FIG. 4 is a top view of a part of FIG. 3.
Figure 5:
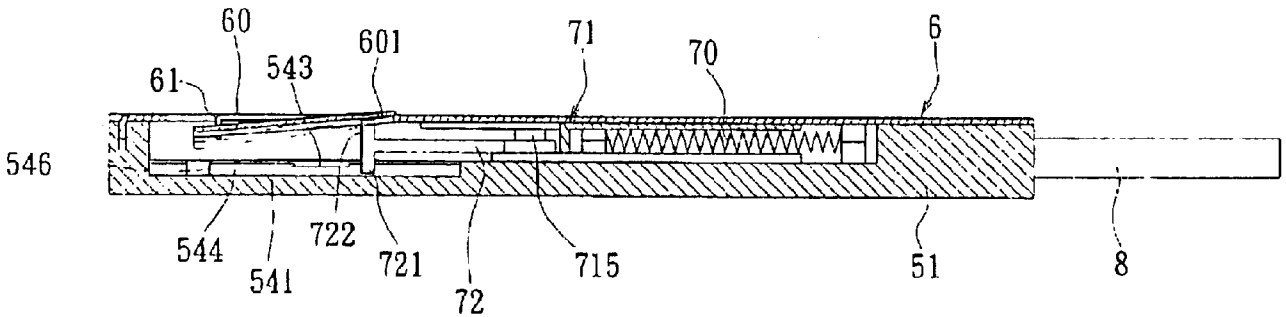
FIG. 5 shows the cross-sectional view along the line 5—5 of FIG. 4.
Figure 6:
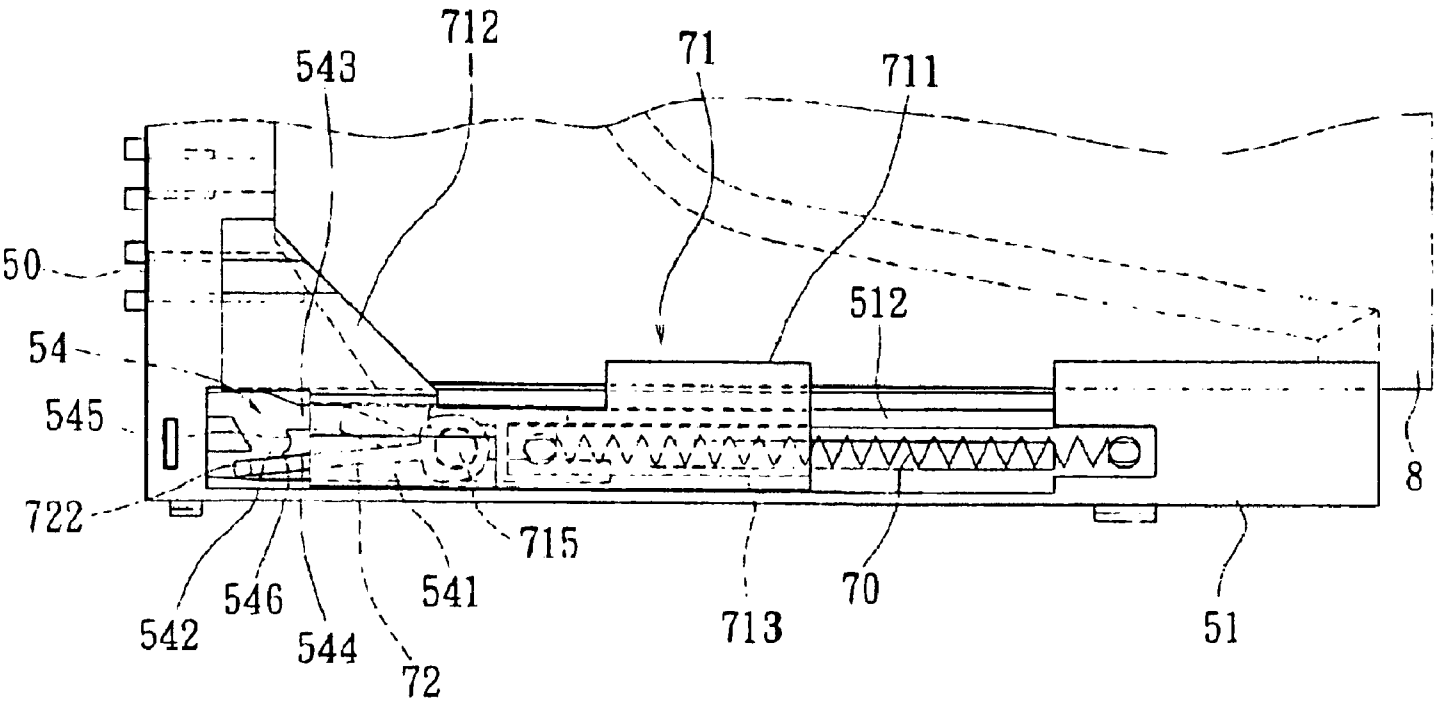
FIG. 6 shows a first operation status of the connector.
Figure 7:
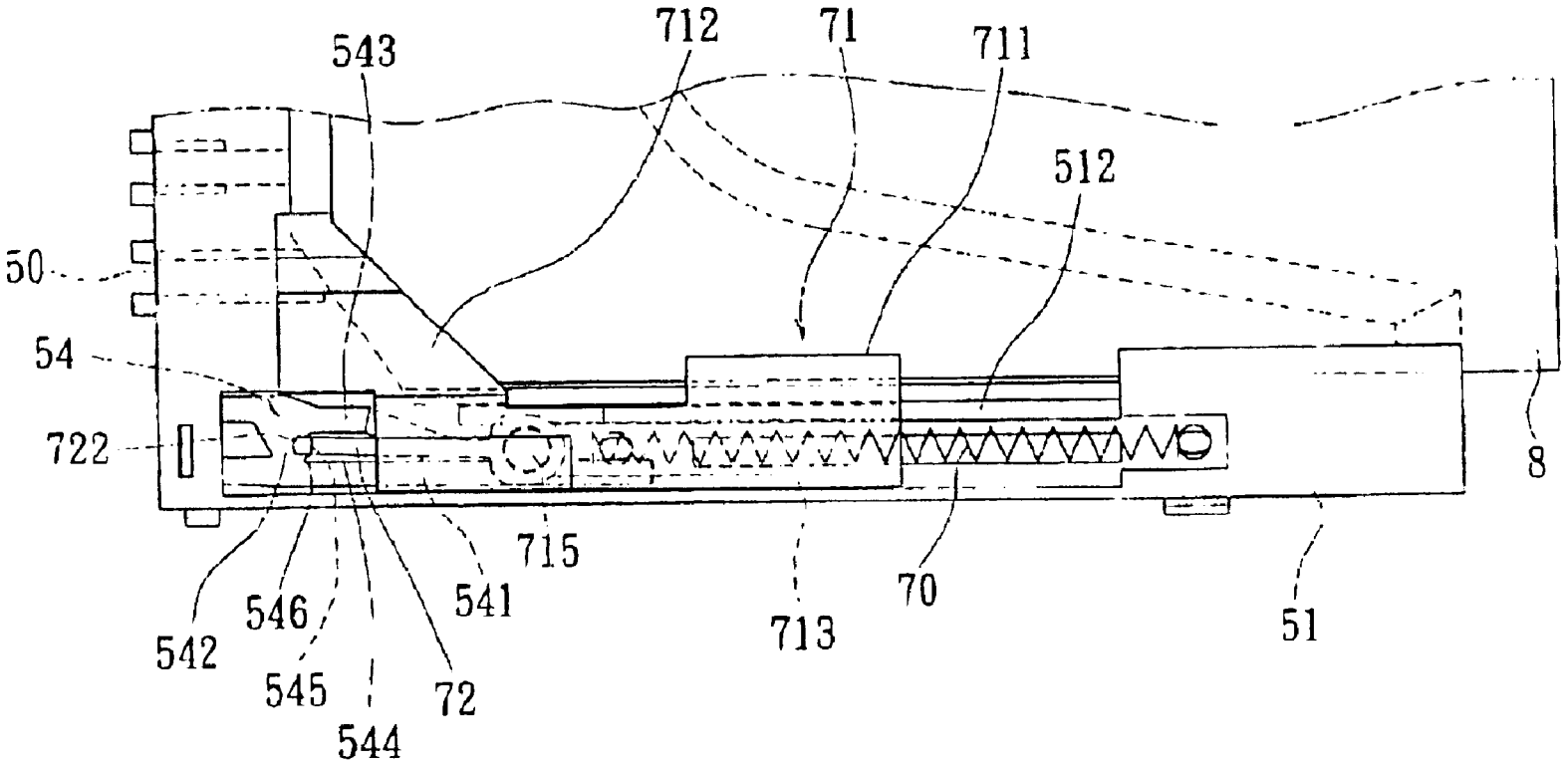
FIG. 7 shows a second operation status of the connector.

As shown in FIGS. 4 and 5, when the electronic card 8 is pushed for the first time, the electronic card 8 is inserted into the space 53, moving along the slots 511 and 512 of the first and second arms 51 and 52, to push the contact portion 712 of the slide member 71. The slide member 71 thus moves forward to make a forward movement of the guide lever 72. Next, the downward protrusion 721 of the guide lever 72 is guided to move in the forwarding portion, 541. The height between the connection of the forwarding portion 541 and the returning portion 543 will prevent the downward protrusion 721 from moving into the returning portion 543. Meanwhile, the upward protrusion 722 of the guide lever 72 is guided to move in the recessed rail 601 of the spring leaf 60 of the shielding shell 6, and lift up the spring leaf 60. Therefore, the spring leaf 60 is pressed down the upward protrusion 722 and make the guide lever 72 more securely guided moving along the forwarding portion 541 of the one-way track As shown in FIGS. 6 and 7, the electronic card 8 is inserted. The upward protrusion 722 of the guide lever 72 passes through the spring leaf 60 so that the spring leaf 60 is released to its normal position. Therefore, the upward protrusion 722 is contacted with the tilt 602 of the spring leaf 60. Thereafter, by the force exerting from the resilient member 70, the slide member 71 is withdrawn to move back the guide lever 72 so that the upward protrusion 722 is moved along the tilt 602 to rest on the stop portion 61 of the shielding shell 6. Meanwhile, the downward protrusion 721 passes over the turning point 546 to move in the positioning portion 542 of the one-way track 54 and rest on the recess 545 of the positioning block 544. As such, the guide lever 72 is guided by the spring leaf 60 to the positioning portion 542 to avoid the turning point 546 being abraded.

Figure 8:
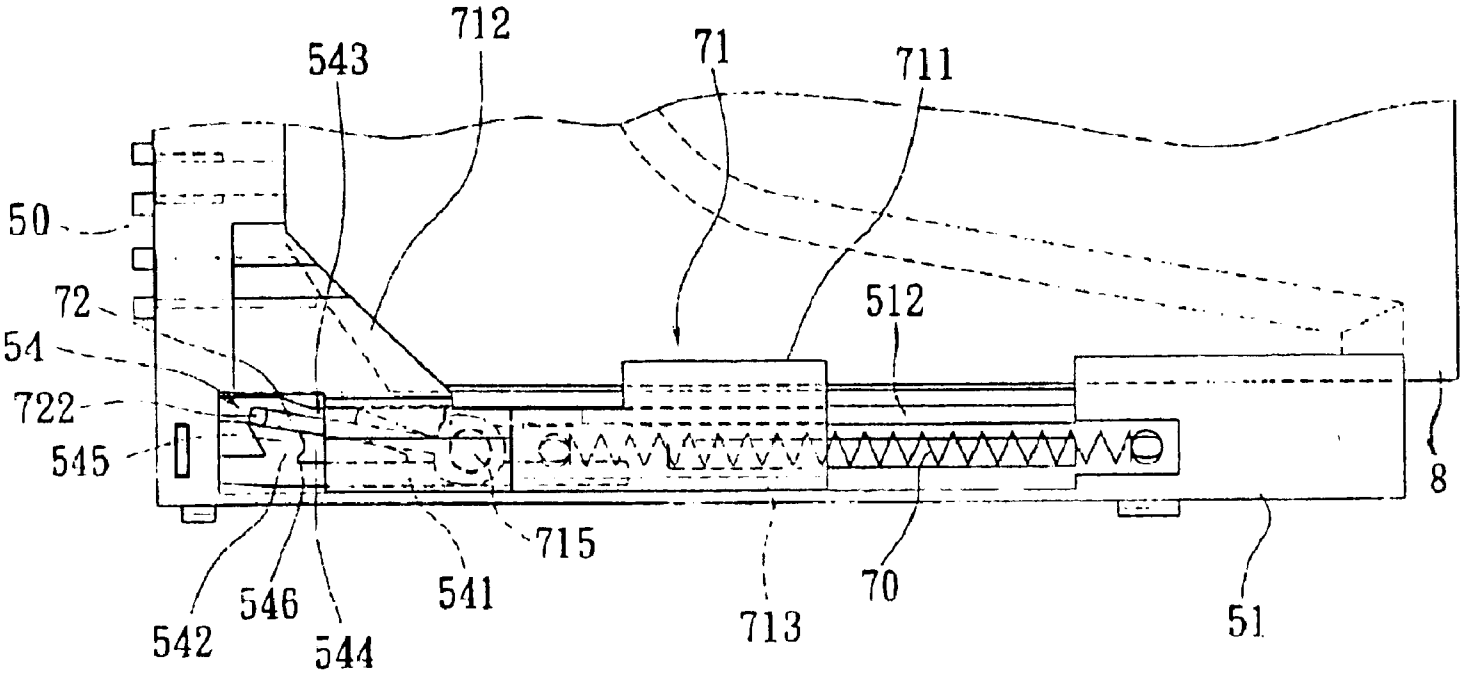
FIG. 8 shows a third operation status of the connector.

As shown in FIG. 8, while pushing the electronic card 8 the second time, the electronic card 8 is ejected from the space 53. As shown, the pushing force of the electronic card 8 again pushes the contact portion 712 of the slide member 71. The downward protrusion 721 of the guide lever 72 moves away from recess 545 towards the returning portion 142 through the positioning portion 542. Therefore, by the restoring force exerting from the resilient member 70, the guide lever 72 moves along the returning portion 543 and the slide member 71 to generate an ejecting force against the electronic card 8 via the contact portion 712. The electronic card 8 can thus be ejected from the connector.

By installing the metal sheet 15 in the forwarding portion 140, both the guiding head and the recessed curved front surface 153 for hooking the guiding heat 300 are made of metal material, the one-way track 14 of the insulating body 1 will not be abraded by movement of the guiding head 300. Therefore, the lifetime of the connector is lengthened.

This disclosure provides exemplary embodiments of the present invention. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A connector for an electronic card, comprising:

an insulating body, comprising a base, and an elongate first arm and an elongate second arm extending perpendicularly from two ends of the base, having a one-way track with a forwarding portion, a positioning portion, and a returning portion consecutively formed on the first arm, the first arm and the second arm constructing an open space for receiving the electronic card;

a shielding member, covering the insulating body, comprising a spring leaf with a recessed rail corresponding to the forwarding portion, a free end of the spring leaf being bent to the forwarding portion and forming a tilt toward the positioning portion; and a pushing assembly, comprising a resilient member, a slide member and a guide lever, one end of the resilient member being mounted to the first arm and the other end thereof connected to the slide member, the guide lever being pivotably connected to the slide member at one end thereof and having a first protrusion and a second protrusion at the other end thereof for slidably moving in the one-way track and the recessed rail, respectively;

whereby, when the electronic card is inserted, the second protrusion is guided by the tilt to rest in the positioning portion; and when the electronic card is ejected, the first protrusion is guided in the returning portion back to the forwarding portion.

2. The connector according to claim 1, wherein the insulating body further includes corresponding slots formed in the first arm and the second arm.

3. The connector according to claim 1, wherein the one-way track forms a positioning block circumscribed thereby, and the positioning block has a recess along the positioning portion.

4. The connector according to claim 3, wherein the shielding member includes a stop portion corresponding to the recess of the positioning block.

5. The connector according to claim 1, wherein the returning portion forms an upraising slope to have a higher surface at the connection with the forwarding portion.

6. The connector according to claim 1, wherein the first arm includes a slide rail, and the slide member includes a contact portion and a slide portion with a slide rack for sitting in the slide rail.

7. The connector according to claim 6, wherein the slide member is slidably mounted on the first arm and a room is formed to furnish the resilient member therein.

* * * * *